US010690137B2

(12) United States Patent
Liu et al.

(10) Patent No.: US 10,690,137 B2
(45) Date of Patent: Jun. 23, 2020

(54) VENTILATION FAN

(71) Applicant: DELTA ELECTRONICS, INC., Taoyuan (TW)

(72) Inventors: Yuan-Chuan Liu, Taoyuan (TW); Chih-Hua Lin, Taoyuan (TW); Chung-We Yeh, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 57 days.

(21) Appl. No.: 16/001,339

(22) Filed: Jun. 6, 2018

(65) Prior Publication Data

US 2019/0376522 A1 Dec. 12, 2019

(51) Int. Cl.

| | |
|---|---|
| ***F04D 25/08*** | (2006.01) |
| ***F24F 13/20*** | (2006.01) |
| ***F24F 13/32*** | (2006.01) |
| ***F04D 29/70*** | (2006.01) |
| ***F04D 29/66*** | (2006.01) |
| ***F04D 29/42*** | (2006.01) |

(52) U.S. Cl.

CPC ..... *F04D 25/08* (2013.01); *F04D 29/4226* (2013.01); *F04D 29/665* (2013.01); *F04D 29/703* (2013.01); *F24F 13/20* (2013.01); *F24F 13/32* (2013.01); *F24F 2013/205* (2013.01)

(58) Field of Classification Search

CPC .... F04D 25/08; F04D 29/665; F04D 29/4226; F04D 29/703

USPC ..... 415/121.2

See application file for complete search history.

(56) References Cited

U.S. PATENT DOCUMENTS

| | | | | |
|---|---|---|---|---|
| 5,820,458 | A * | 10/1998 | Lai | F04D 25/08 454/354 |
| 6,494,152 | B2 * | 12/2002 | Gatley, Jr. | F01D 25/24 110/162 |
| 9,097,265 | B1 * | 8/2015 | Tom | F04D 29/626 |
| 9,689,581 | B2 * | 6/2017 | Zakula | F24F 7/065 |
| 2010/0284803 | A1 * | 11/2010 | Yang | F04D 25/12 415/204 |
| 2011/0250060 | A1 * | 10/2011 | Tanaka | F04D 29/4226 415/204 |
| 2012/0014789 | A1 * | 1/2012 | Shirahama | F04D 27/009 415/224 |

(Continued)

FOREIGN PATENT DOCUMENTS

| | | | | |
|---|---|---|---|---|
| WO | WO-2017033303 | A1 * | 3/2017 | F04D 25/08 |

*Primary Examiner* — J. Todd Newton

(74) *Attorney, Agent, or Firm* — Muncy, Geissler, Olds & Lowe, P.C.

(57) ABSTRACT

A ventilation fan includes a fan and a housing. The fan includes a base, a scroll casing, and an impeller. The base is used for supporting a driving device. The scroll casing has an air inlet, an air outlet, a top portion, a bottom portion corresponding to the top portion, and a slope surface connecting the top portion and an edge of the air outlet. The top portion and the bottom portion together define a channel height, and the ratio of the channel height to the height of the air outlet ranges from 1.1 to 2. The channel height ranges from 110 mm to 200 mm. The impeller is disposed in the scroll casing, and the driving device drives the impeller to rotate. The housing is used for accommodating the fan, and has an opening corresponding to the air outlet of the scroll casing.

17 Claims, 6 Drawing Sheets

(56) References Cited

U.S. PATENT DOCUMENTS

2013/0072105 A1* 3/2013 Yang ..... F04D 25/08
454/350
2013/0315731 A1* 11/2013 Yang ..... F04D 25/088
416/5
2014/0065940 A1* 3/2014 Penlesky ..... F04D 25/14
454/230
2015/0125292 A1* 5/2015 Karst ..... F04D 25/166
415/213.1
2015/0184878 A1* 7/2015 Su ..... F24F 7/007
415/206
2015/0354595 A1* 12/2015 Su ..... F04D 29/4226
415/201
2016/0017892 A1* 1/2016 Fujisono ..... F04D 17/16
415/204
2016/0025109 A1* 1/2016 Katsumata ..... F04D 29/162
415/119
2016/0047386 A1* 2/2016 Uehara ..... F04D 29/4226
415/204
2016/0161133 A1* 6/2016 Oh ..... F24F 7/065
415/62
2016/0195106 A1* 7/2016 Uehara ..... F04D 29/422
415/119

* cited by examiner

VENTILATION FAN

BACKGROUND OF THE DISCLOSURE

Field of Disclosure

The present disclosure relates to a ventilation fan and, in particular, to a ventilation fan that can reduce the noise and increase the air pressure and air quantity.

Related Art

As the progress of technology and industry, people have paid more attention on their living qualities. One of most concerned topics is the quality of air, which is highly related to people's health. However, in order to reduce noise interference, isolate heat transfer, and keep the room temperature, the modern buildings are mostly constructed by specific material to provide airtight indoor spaces. Accordingly, the air discharging of the indoor spaces becomes insufficient, so that some harmful contaminants cannot be exhausted effectively and still remained in the rooms.

In addition, the general ventilation fan is designed to simply exchange inside and outside air, and it cannot adjust the air exchange modes according to different requirements of the users. Besides, the conventional ventilation fan usually generates laud noise. Generally, the conventional ventilation fan is composed of an air outlet, an impeller, an air channel, and a grill. The spatial design of the air channel has a certain limitation due to the height of the impeller and the size of the air outlet. Thus, this conventional ventilation fan has poor air exchange performance and cannot effectively reduce the noise.

Therefore, it is desired to provide a ventilation fan that can reduce the noise and increase the air pressure and air quantity.

SUMMARY OF THE DISCLOSURE

An objective of the present disclosure is to provide a ventilation fan that can reduce the noise and increase the air pressure and air quantity.

This disclosure provides a ventilation fan, which includes a fan and a housing. The fan includes a base, a scroll casing and an impeller. The base is used for supporting a driving device. The scroll casing has an air inlet, an air outlet, a top portion, a bottom portion corresponding to the top portion, and a slope surface connecting the top portion and an edge of the air outlet. The top portion and the bottom portion together define a channel height. A ratio of the channel height to a height of the air outlet ranges from 1.1 to 2, and the channel height ranges from 110 mm to 200 mm. The impeller is disposed in the scroll casing, and the driving device drives the impeller to rotate. The housing is used for accommodating the fan and has an opening corresponding to the air outlet of the scroll casing. An air outlet duct is disposed on the side of the housing and communicated with the air outlet of the scroll casing, and a baffle is disposed inside the air outlet duct.

In one embodiment, a ring structure is disposed on the base and located around a periphery of a driving circuit of the driving device.

In one embodiment, the ventilation fan further includes a grill assembling on the housing.

In one embodiment, an extension direction of the air inlet is perpendicular to an extension direction of the air outlet.

In one embodiment, an included angle between an extension direction of the top portion and the slope surface ranges from 16 degrees to 52 degrees.

In one embodiment, the included angle between the extension direction of the top portion and the slope surface is 17.7 degrees.

In one embodiment, the channel height is 125 mm, and the height of the air outlet is 100 mm.

In one embodiment, an accommodating space is formed between the top portion and the bottom portion, and the impeller is disposed in the accommodating space.

In one embodiment, the accommodating space is an annular space.

In one embodiment, the driving device is a motor, and the motor includes a driving circuit for driving the impeller to rotate.

In one embodiment, a diversion element is disposed on the scroll casing and located around of the inlet of the scroll casing.

As mentioned above, in the ventilation fan of this disclosure, the slope surface connects the top portion and an edge of the air outlet, a ratio of the channel height to the height of the air outlet ranges from 1.1 to 2, and the channel height ranges from 110 mm to 200 mm. Thus, the ventilation fan of the disclosure can reduce the noise and increase the air pressure and air quantity.

BRIEF DESCRIPTION OF THE DRAWINGS

The present disclosure will become more fully understood from the subsequent detailed description and accompanying drawings, which are given by way of illustration only, and thus are not limitative of the present disclosure, and wherein.

DETAILED DESCRIPTION OF THE DISCLOSURE

Figure 1:
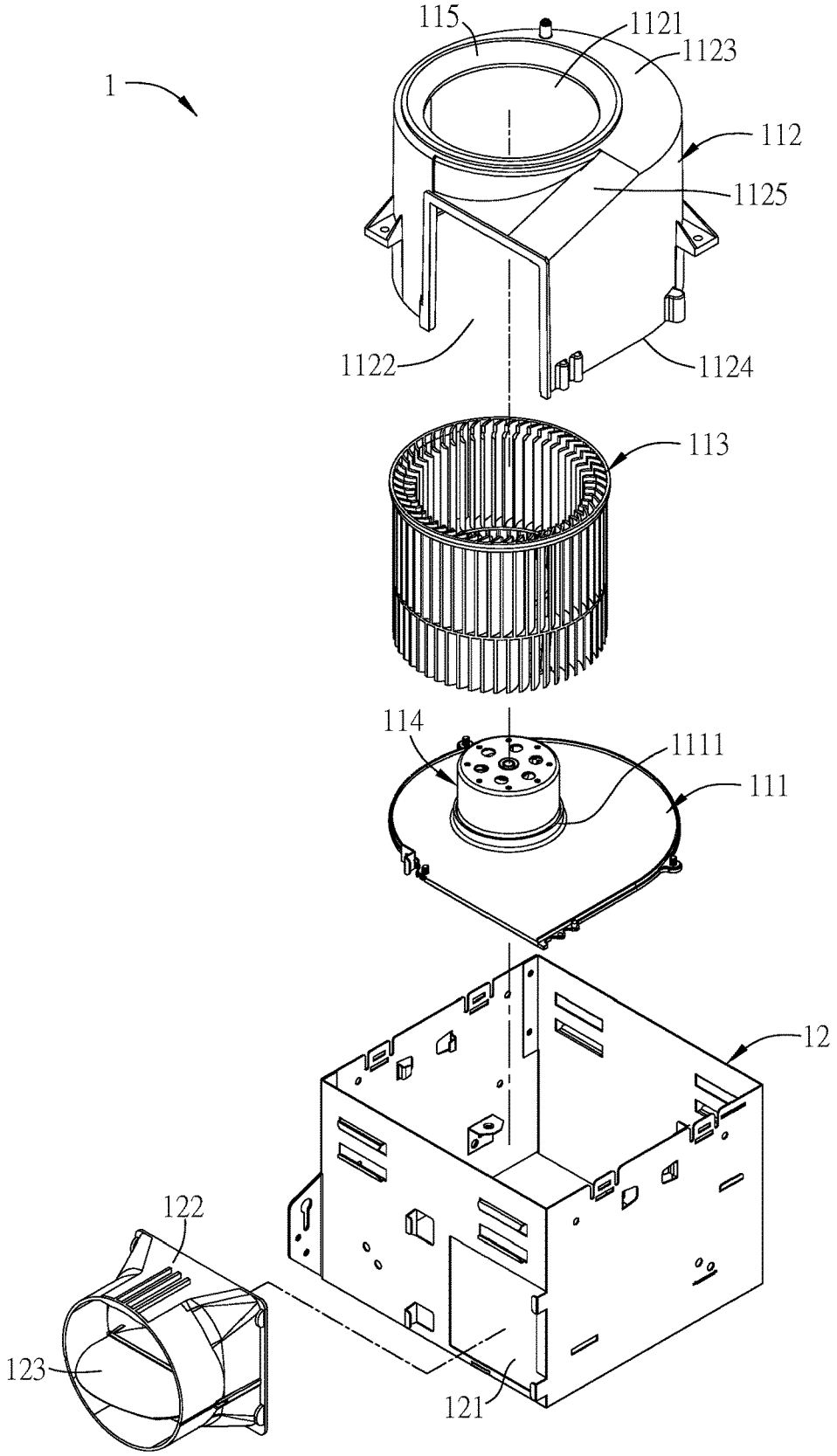
FIG. 1 is a schematic diagram showing a ventilation fan according to an embodiment of the disclosure.

The present disclosure will be apparent from the following detailed description, which proceeds with reference to the accompanying drawings, wherein the same references relate to the same elements.

A ventilation fan of this disclosure can reduce the noise and increase the air pressure and air quantity. The structure and features of the ventilation fan of the disclosure will be described hereinafter.

FIGS. 1 to 4 are schematic diagrams showing a ventilation fan 1 according to an embodiment of the disclosure. Referring to FIGS. 1 to 4, the ventilation fan 1 includes a fan 11 and a housing 12. The fan 11 includes a base 111, a scroll casing 112, and an impeller 113. The base 111 is used for supporting a driving device 114 (also shown in FIG. 6). The scroll casing 112 has an air inlet 1121, an air outlet 1122, a top portion 1123, a bottom portion 1124 corresponding to the top portion 1123, and a slope surface 1125 connecting the top portion 1123 and an edge of the air outlet 1122. The top portion 1123 and the bottom portion 1124 together define a channel height H. A ratio of the channel height H to a height of the air outlet 1122 ranges from 1.1 to 2, and the channel height H ranges from 110 mm to 200 mm. The impeller 113 is disposed in the scroll casing 112, and the driving device 114 drives the impeller 113 to rotate. The housing 12 is used for accommodating the fan 11 and has an opening 121 corresponding to the air outlet 1122 of the scroll casing 112. An air outlet duct 122 is disposed on the side of the housing 12 and communicated with the air outlet 1122 of the scroll casing 112, and a baffle 123 is disposed inside the air outlet duct 122.

Figure 2:
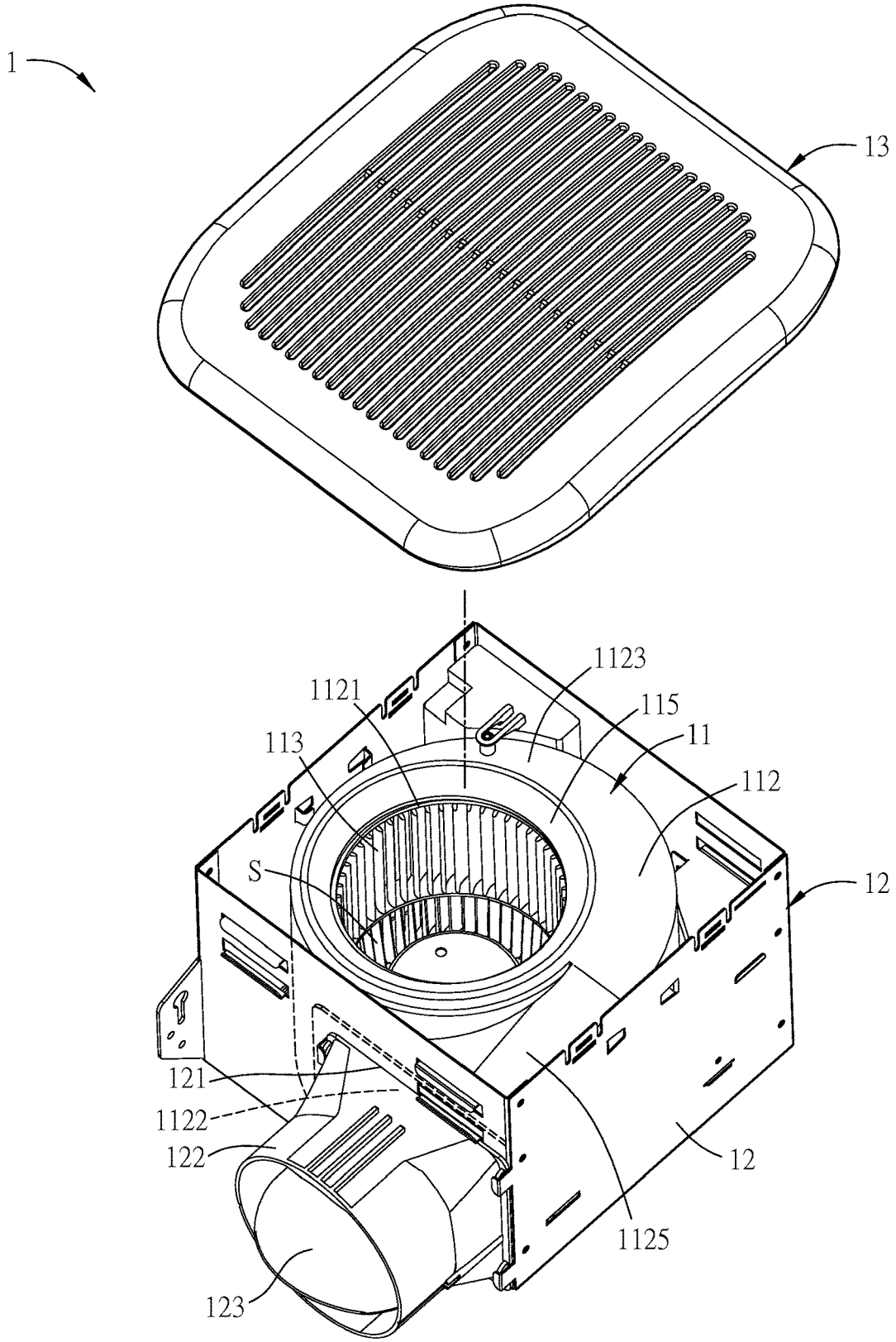
FIG. 2 is another schematic diagram of the ventilation fan according to the embodiment of the disclosure.
Figure 4:
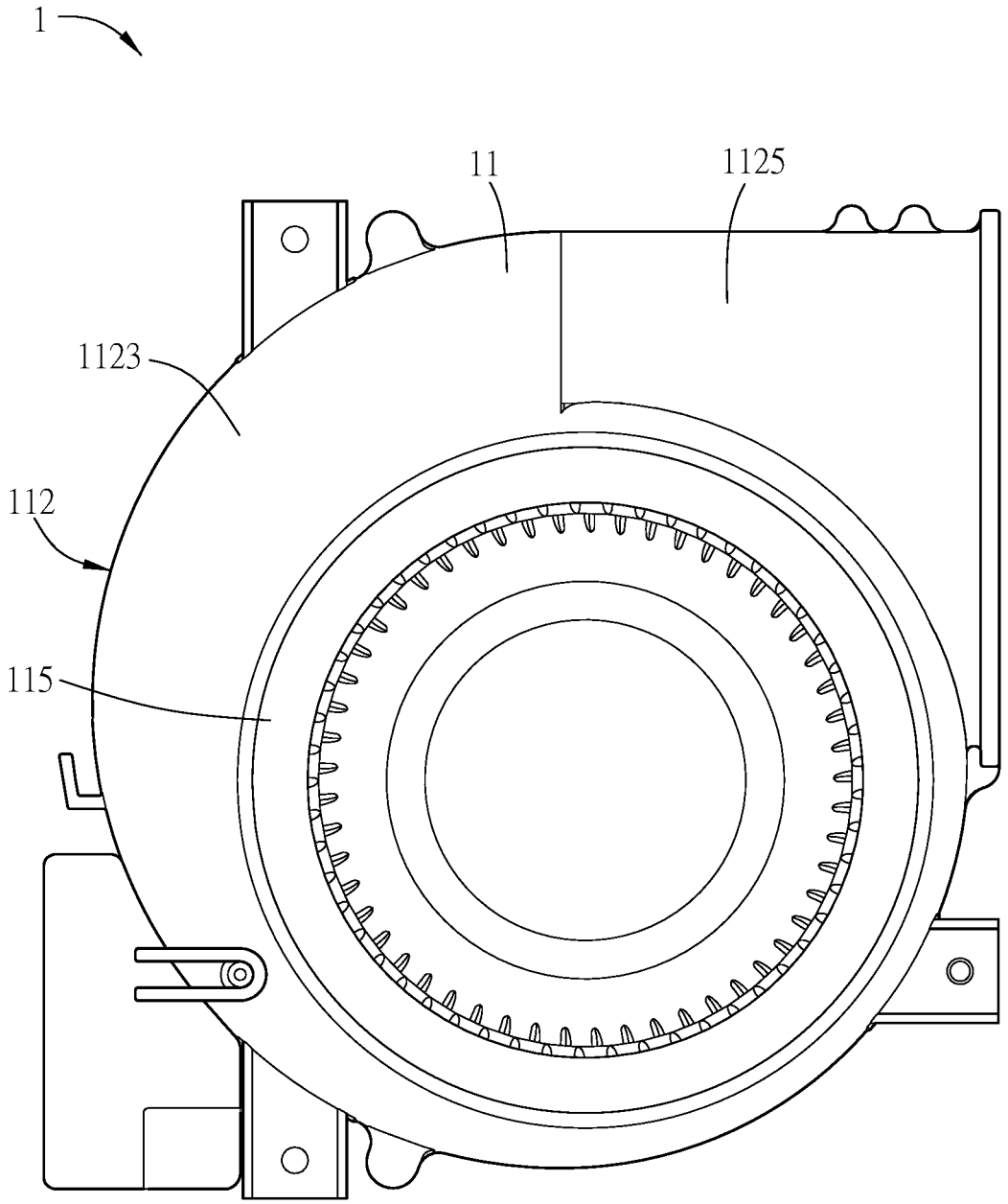
FIG. 4 is another schematic diagram of the ventilation fan according to the embodiment of the disclosure.

Besides, as shown in FIGS. 1-2 and 4, a diversion element 115 is disposed on the scroll casing 112 and located around of the inlet of the scroll casing 112.

Figure 5:
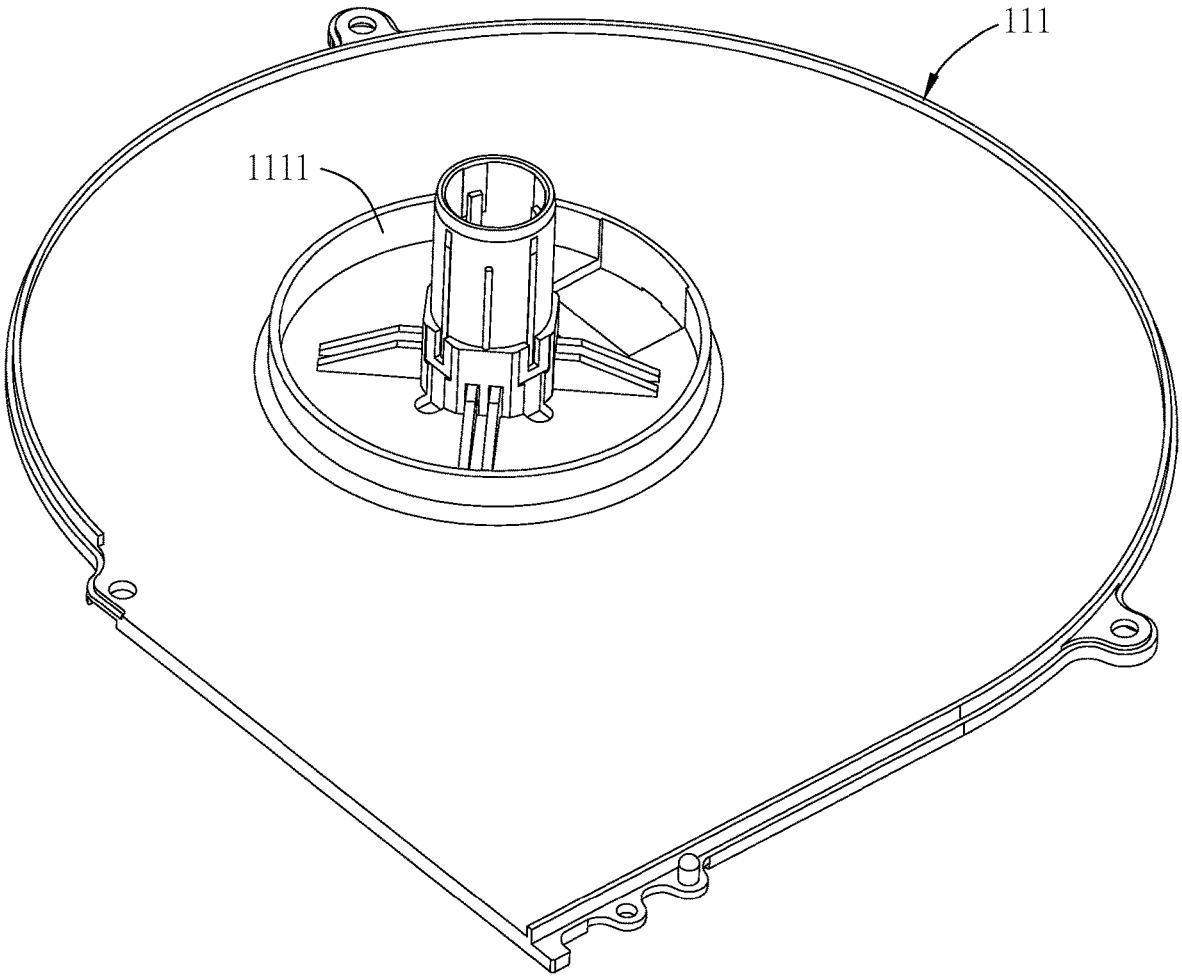
FIG. 5 is a schematic diagram showing a ventilation fan according to another embodiment of the disclosure.
Figure 6:
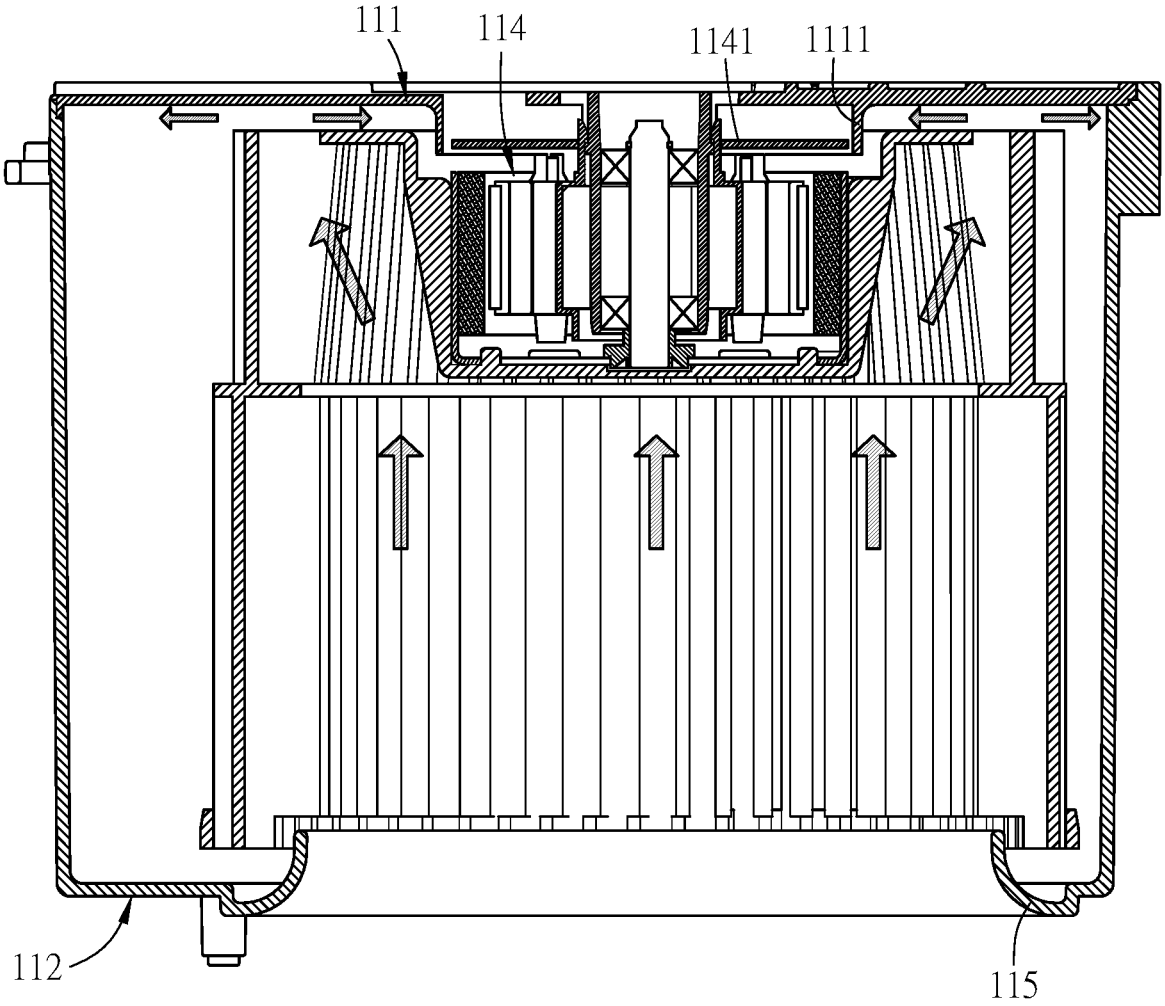
FIG. 6 is another schematic diagram of the ventilation fan according to another embodiment of the disclosure.

FIGS. 5 and 6 are schematic diagrams showing a ventilation fan 1 according to another embodiment of the disclosure. In this embodiment, a ring structure 1111 is disposed on the base 111 and located around the periphery of a driving circuit 1141 of the driving device 114. In particular, the ring structure 1111 can prevent water or moisture to enter and accumulate in the driving device 114, thereby reducing the risk of malfunction of the driving device 114. The arrows shown in FIG. 6 indicate the flowing direction of moisture.

In this embodiment, the ventilation fan 1 further includes a grill 13, which is assembled on the housing 12.

Figure 3:
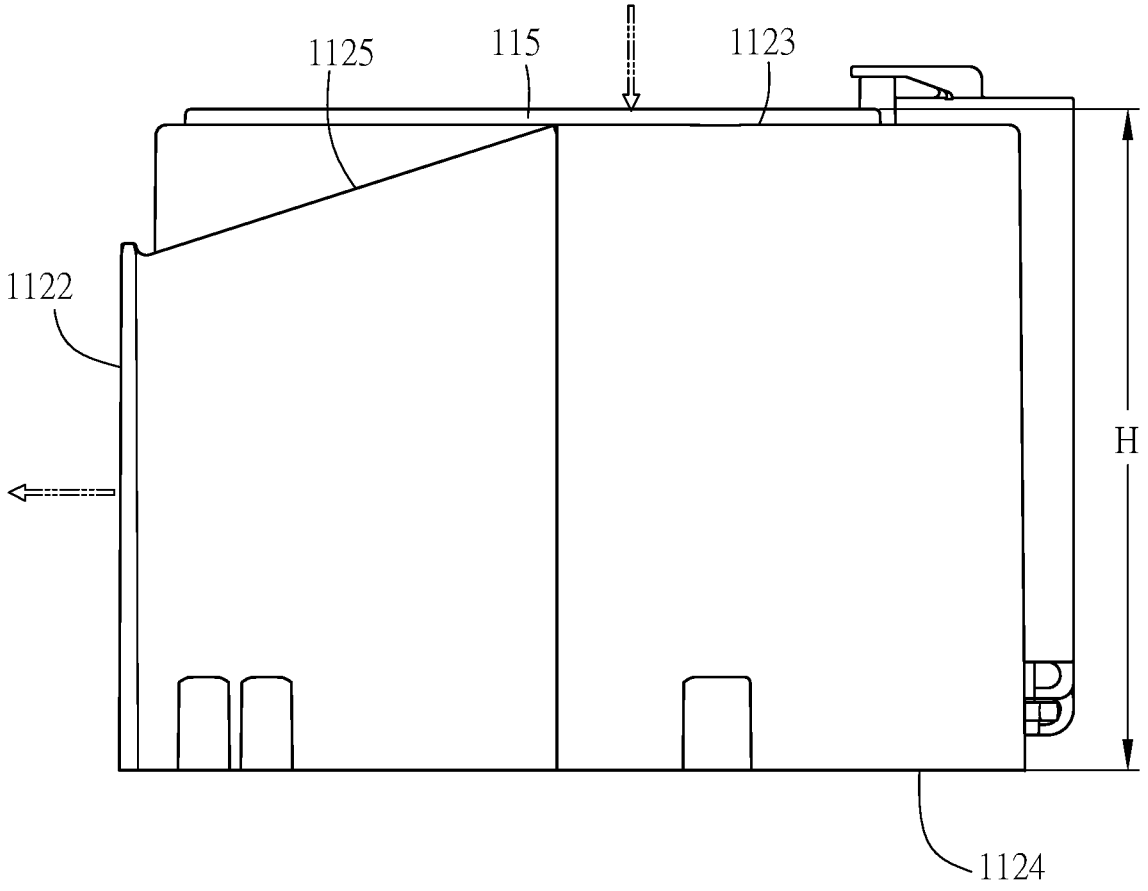
FIG. 3 is another schematic diagram of the ventilation fan according to the embodiment of the disclosure.

In this embodiment, the extension direction of the air inlet 1121 is perpendicular to the extension direction of the air outlet 1122 (referring to the arrow directions of FIG. 3).

In this embodiment, an included angle between the extension direction of the top portion 1123 and the slope surface 1125 ranges from 16 degrees to 52 degrees. Preferably, the included angle between the extension direction of the top portion 1123 and the slope surface 1125 is 17.7 degrees.

In this embodiment, the channel height H is 125 mm, and the height of the air outlet 1122 is 100 mm (see FIG. 3). In other words, the ratio of the channel height H to the height of the air outlet 1122 is 1.25.

In this embodiment, an accommodating space S is formed between the top portion 1123 and the bottom portion 1124, and the impeller 113 is disposed in the accommodating space S.

In this embodiment, the accommodating space S is an annular space.

In this embodiment, the driving device 114 is a motor, and the motor includes a driving circuit for driving the impeller 113 to rotate.

To sum up, in the ventilation fan 1 of this disclosure, the slope surface 1125 connects the top portion 1123 and the edge of the air outlet 1122, a ratio of the channel height H to the height of the air outlet 1122 ranges from 1.1 to 2, and the channel height H ranges from 110 mm to 200 mm. Thus, the ventilation fan 1 of the disclosure can reduce the noise and increase the air pressure and air quantity.

Although the present disclosure has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present disclosure.

What is claimed is:

1. A ventilation fan assembly, comprising:

a fan comprising:

a base supporting a driving device, a scroll casing having an air inlet, an air outlet, a top portion, a bottom portion corresponding to the top portion, and a slope surface connecting the top portion and an edge of the air outlet, wherein the top portion and the bottom portion together define a channel height, a ratio of the channel height to a height of the air outlet ranges from 1.1 to 2, and the channel height ranges from 110 mm to 200 mm, and an impeller disposed in the scroll casing, wherein the driving device drives the impeller to rotate; and a housing for accommodating the fan and having an opening corresponding to the air outlet of the scroll casing, wherein an air outlet duct is disposed on the side of the housing and communicated with the air outlet of the scroll casing, and a baffle is disposed inside the air outlet duct;

wherein the air inlet has a circular edge, the circular edge has a first point, a second point and a third point, the first point is closer to the opening than the third point, the second point is between the first point and the third point along the circular edge, and the slope surface is connected to the top portion beside the second point of the circular edge.

2. The ventilation fan assembly according to claim 1, wherein a ring structure is disposed on the base and located around a periphery of a driving circuit of the driving device.

3. The ventilation fan assembly according to claim 1, further comprising a grill assembly on the housing.

4. The ventilation fan assembly according to claim 1, wherein an extension direction of the air inlet is perpendicular to an extension direction of the air outlet.

5. The ventilation fan assembly according to claim 1, wherein an included angle between an extension direction of the top portion and the slope surface ranges from 16 degrees to 52 degrees.

6. The ventilation fan assembly according to claim 5, wherein the included angle between the extension direction of the top portion and the slope surface is 17.7 degrees.

7. The ventilation fan assembly according to claim 1, wherein the channel height is 125 mm, and the height of the air outlet is 100 mm.

8. The ventilation fan assembly according to claim 1, wherein an accommodating space is formed between the top portion and the bottom portion, and the impeller is disposed in the accommodating space.

9. The ventilation fan assembly according to claim 8, wherein the accommodating space is an annular space.

10. The ventilation fan assembly according to claim 1, wherein the driving device is a motor, and the motor comprises a driving circuit for driving the impeller to rotate.

11. The ventilation fan assembly according to claim 1, wherein a diversion element is disposed on the scroll casing and located around of the inlet of the scroll casing.

12. The ventilation fan assembly according to claim 1, wherein the slope surface gradually becomes wide from the top surface to the opening.

13. The ventilation fan assembly according to claim 1, wherein the scroll casing has a sidewall surrounding the air inlet, the slope surface has a curve edge along the sidewall from the top surface to the opening, and a height of the curve edge decreases from the top surface to the opening.

14. The ventilation fan assembly according to claim 1, wherein a curve length of the circular edge from the first point to the second point is about ¼ of the total length of the circular edge.

15. A ventilation fan assembly, comprising: a fan comprising:

a base supporting a driving device, a scroll casing having an air inlet, an air outlet, a top portion, a bottom portion corresponding to the top portion, and a slope surface connecting the top portion and an edge of the air outlet, wherein the top portion and the bottom portion together define a channel height, a ratio of the channel height to a height of the air outlet ranges from 1.1 to 2, and an impeller disposed in the scroll casing, wherein the driving device drives the impeller to rotate; and a housing for accommodating the fan and having an opening corresponding to the air outlet of the scroll casing, wherein an air outlet duct is disposed on the side of the housing and communicated with the air outlet of the scroll casing, and a baffle is disposed inside the air outlet duct;

wherein the scroll casing has a sidewall surrounding the air inlet, the slope surface has a slope edge along the sidewall from the top surface to the opening, and a height of the slope edge decreases from the top surface to the opening.

16. The ventilation fan assembly according to claim 15, wherein the slope surface gradually becomes wide from the top surface to the opening, and the slope edge is a curve edge.

17. The ventilation fan assembly according to claim 16, wherein the air inlet has a circular edge, the circular edge has a first point, a second point and a third point, the first point is closer to the opening than the third point, the second point is between the first point and the third point along the circular edge, the slope surface is connected to the top portion beside the second point of the circular edge, a curve length of the circular edge from the first point to the second point is about ¼ of the total length of the circular edge, an included angle between an extension direction of the top portion and the slope surface ranges from 16 degrees to 52 degrees, and the channel height ranges from 110 mm to 200 mm.

* * * * *